US006044975A

United States Patent [19]

Dirx et al.

[11] Patent Number: 6,044,975

[45] Date of Patent: Apr. 4, 2000

[54] THERMAL PRINTER WITH SHEET PRESSURE MEANS

[75] Inventors: Lieven Dirx, Oud-Turnhout; Patrick Van Wynsberge, Zwijndrecht, both of Belgium

[73] Assignee: Agfa-Gevaert, Mortsel, Belgium

[21] Appl. No.: 09/164,515

[22] Filed: Sep. 30, 1998

Related U.S. Application Data

[62] Division of application No. 08/977,994, Nov. 25, 1997.
[60] Provisional application No. 60/038,766, Feb. 20, 1997.

[30] Foreign Application Priority Data

Nov. 28, 1996 [EP] European Pat. Off. ..... 96203360

[51] Int. Cl.[7] ..... B65D 85/62
[52] U.S. Cl. ..... 206/451; 206/455
[58] Field of Search ..... 206/449, 451, 206/455, 454; 428/913; 503/200, 226, 227

[56] References Cited

U.S. PATENT DOCUMENTS

| | | | |
|---|---|---|---|
| 3,618,752 | 11/1971 | Barker et al. | 206/455 |
| 4,458,133 | 7/1984 | Macken | 219/121.72 |
| 4,590,497 | 5/1986 | Shibata et al. | 428/913 |
| 4,778,713 | 10/1988 | Akao | 206/455 |
| 4,830,186 | 5/1989 | George et al. | 206/449 |
| 5,529,413 | 6/1996 | Kamikubota et al. | 101/409 |

*Primary Examiner*—Jim Foster
*Attorney, Agent, or Firm*—Baker Botts L.L.P.

[57] ABSTRACT

A pack (12) of thermal-sensitive sheets, which comprises a stack of sheets (77) bearing each a thermal-sensitive layer on one sheet side, a protective foil (79) in contact with the thermal-sensitive layer of the outermost sheet of the stack, and a rupturable strap (78) encircling the stack of sheets and the protective foil, and attached to such foil by means of a rupturable seal (83).

10 Claims, 11 Drawing Sheets

THERMAL PRINTER WITH SHEET PRESSURE MEANS

This is a divisional of copending application Ser. No. 08/977,994 filed Nov. 25, 1997, pending, also claims the benefit of Provisional 60/038,766 filed Feb. 20, 1997.

BACKGROUND OF THE INVENTION

1. Field of the Invention

The present invention relates to a method for loading a stack of substantially light-insensitive sheets in an apparatus for the image-wise exposure of such sheets, and to a pack of substantially light-insensitive sheets, thermal-sensitive sheets in particular.

2. Description of the Prior Art

Many systems for loading stacks of sheets in a photographic processing machine are known. They include so-called daylight loading systems in which a lighttightly wrapped sheet pack is put in an opened magazine-like slide which then is lighttightly closed, after which the wrapping is manually or automatically removed and the sheets can be taken from the stack one-by-one for their exposure, or for their automatic loading in an appropriate cassette, e.g. for X-ray photography. These systems also include systems with thermal-sensitive, or more generally non light-sensitive sheets, in which a stack of sheets the protective wrapper of which has been removed is laid in a holder in the machine from which they are dispensed one by one for being image-wise exposed.

In all those cases the stack of sheets lies in a horizontal position so that it is easy for the operator to gently locate a stack of sheets in the apparatus. A disadvantage of the location of sheets in a horizontal plane is a notable increase of the footprint of the processing machine, in particular for the processing of sheets of sizes larger than an A4 size, e.g. sheets measuring 14×14" (35.56×35.56 mm) and 14"×17" (35.56×43.18 mm) as usual in radiography.

SUMMARY OF THE INVENTION

OBJECTS OF THE INVENTION

It is the object of the invention to provide a sheet loading method which requires less floor space of the apparatus in which such sheets are loaded. The term "floor space" is not limited to the loaded apparatus as such, but encompasses also the increase of space caused by the opening of the apparatus which is required for its loading.

It is another object of the invention to provide a novel pack of non light-sensitive sheets, thermal-sensitive sheets in particular.

STATEMENTS OF INVENTION

In accordance with the present invention, a method for loading a stack of substantially light-insensitive sheets in an apparatus which is arranged for image-wise exposing such sheets one by one, comprises loading said stack of sheets in said apparatus by first forwarding it according to a downwardly directed motion which is tilted outwardly of the apparatus, preventing said sheets from moving mutually during such downward motion, and then pivoting said stack of sheets inwardly of the apparatus in a position which is tilted oppositely to the first one whereby the bottom and top side of the stack become reversed.

The fact that the stack of sheets is tilted (with respect to the vertical) has for consequence that the foot print of an apparatus in which such process is applied, can be small.

Suitable angles of tilt are between 20 and 40 angular degrees.

The method according to the invention has the advantage that the sheets can be loaded according to a sliding motion, this as distinct from prior art methods in which a stack of sheets has to be taken with two hands and then lowered in the magazine or on the dispenser platform of the processing apparatus. A sliding motion has the advantage that the sheets can be simply slid out of their opened bag, so that any contact with hands or fingers can be avoided.

According to a suitable embodiment of the method according to the invention, the sheets of a sheet stack are prevented from mutually moving during their downward motion, by holding them together by means of an encircling band in the form of a strap or the like. This avoids any possible damage to the sheets caused by mutual friction or electrostatic charging.

Further protection of the stack of sheets includes providing a protective foil on top of the sheet stack, such foil becoming a bottom foil after the loading of the sheets.

The invention also includes a pack of substantially light-insensitive sheets, which comprises a stack of sheets bearing each an image-forming layer on one sheet side, a protective foil in contact with the image-forming layer of the outermost sheet of the stack, and a strap encircling the stack of sheets and the protective foil.

Suitably, such strap is arranged for easy opening at the side of said protective foil. Such easy opening may be obtained through a rupturable seal between both overlapping ends of the strap.

The mentioned strap may be attached to the protective foil. This has the advantage that the strap keeps the lower sheet(s) of the pack at its (their) place. In the absence of such strap, or of a strap being not attached to the protective top foil, it may occur that frictional forces between the lower sheet(s) of the pack and the base plate of the magazine of the apparatus, cause such sheet(s) to tend to stay behind the other sheets of the stack, whereby they can get partially clamped between the rearside of the sheet stack and the corresponding wall of the magazine.

The invention has been developed in particular for use in thermal printers, with a thermal head for line-wise heating a heat-sensitive sheet to produce an image, such as an image on a transparent support for medical diagnostic purposes, and reference will be made in particular to suchlike printers in the description hereinafter. However, the invention is not limited to this type of printers and its use extends to any apparatus which is loaded with fresh sheets to carry out printing, whether on a thermographic or any other substantially light-insensitive basis.

BRIEF DESCRIPTION OF THE DRAWINGS

The invention will be described hereinafter by way of example with reference to the accompanying drawings in which.

DETAILED DESCRIPTION OF THE INVENTION

Figure 1:
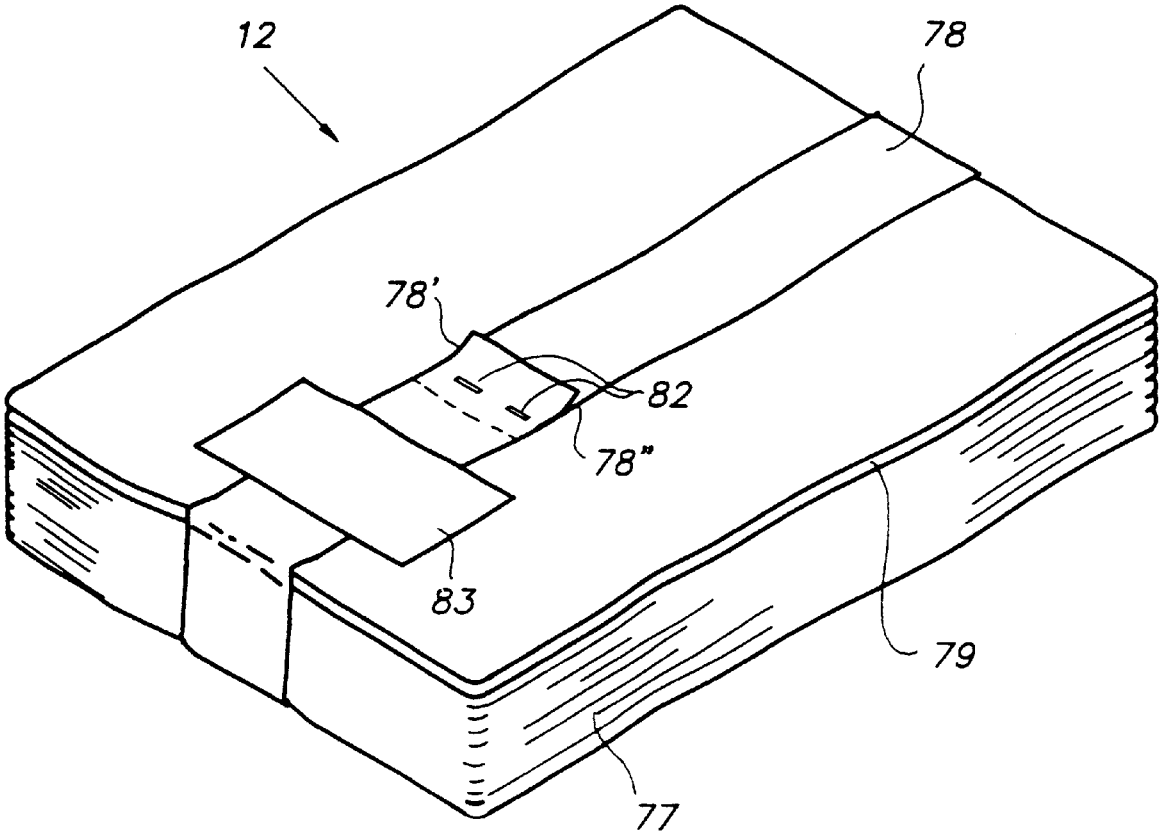
FIG. 1 is a perspective view of one embodiment of a sheet stack of thermal-sensitive sheets, according to the present invention.

Referring to FIG. 1, there is shown a perspective view of one embodiment of a stack of image-forming sheets according to the invention.

A plurality of sheets 77, e.g. 100 sheets each consisting of a terephthalate support bearing at its upper side a thermal-sensitive recording layer, are stacked onto each other. On top of the stack there is a protective foil 79 which has a surface structure and a rigidity which are such that it is capable of protecting the thermal-sensitive layer of the top sheet of the stack against accidental touching and/or undesired pressure during manipulation of the pack. One suitable material for said protective foil is polypropylene in a thickness of 1.0 mm approximately.

The stack of sheets and foil is kept assembled by means of a strap 78 which encircles the stack and which has overlapping ends 78',78", which are rupturally sealed together. Suitable materials for such strap are unidirectionally stretched polypropylene and the like as known in the art. The seal may be formed by small heat-sealed areas 82 which allow rupturing by gripping the frontal or a lateral free margin of the top end 78' of the strap and pulling such end away.

A tape or label 83 may be adhered transversely over the strap in order to limit occasional rotation of the strap about the sheet stack.

Figure 2:
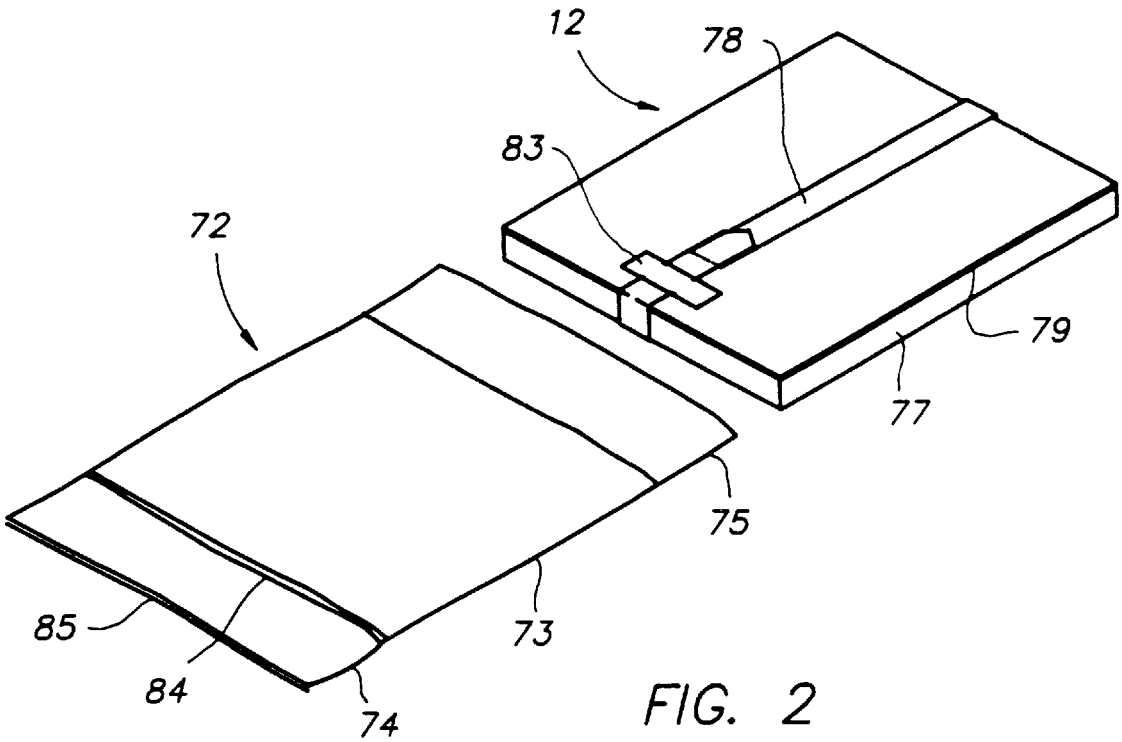
FIG. 2 shows the sheet stack of FIG. 1 and its wrapping bag.
Figure 3:
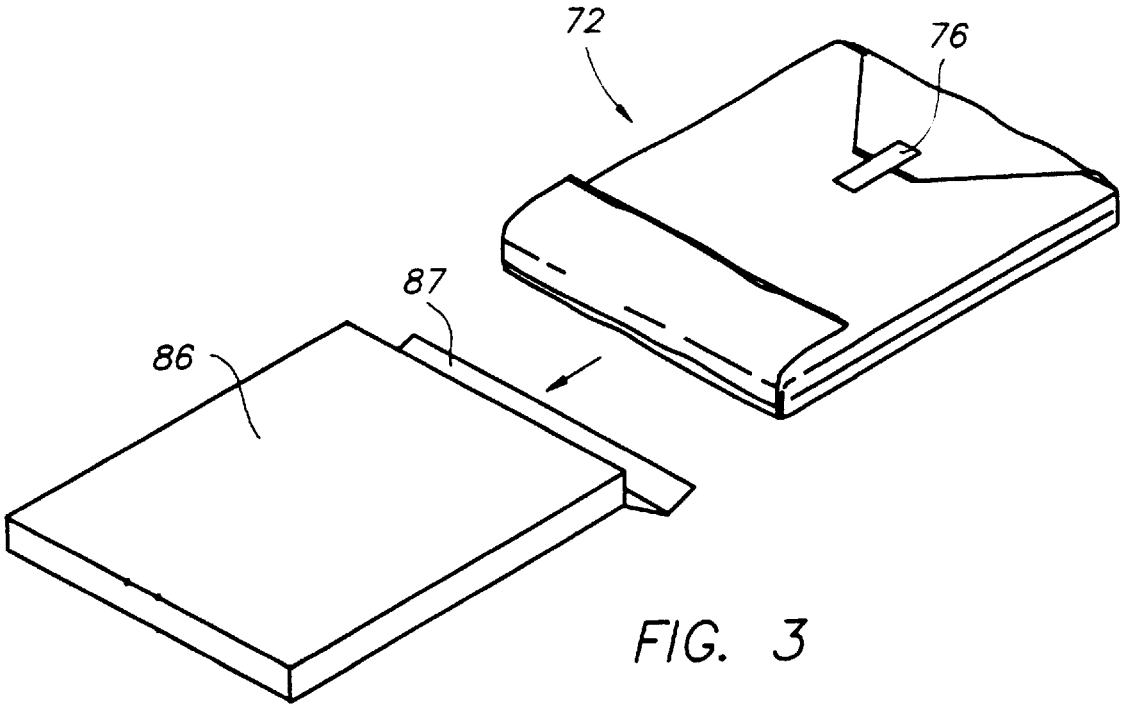
FIG. 3 shows the wrapped sheet stack and its cardboard packaging box.

The stack of sheets is then wrapped in a wrapper 72 in the form of a bag made of PE or a similar material, see FIG. 2, and consisting of a sleeve 73 which has transverse seals 84, 85 to form a tail portion 74. The stack of sheets is slid into the bag and the open end 75 of the bag is then tucked in, folded and provided with a sealing tape 76 to close the pack. Said tape may also have the function of a warranty label for the customer, and be transversely perforated or weakened to make the pack tamper-proof. The sheet pack thus formed can be packaged in a rectangular cardboard box 86 with a hinged lid 87.

The convenient use of the described package is as follows with reference to the following embodiment of a thermal printer which is arranged for co-operation with this package.

Figure 4:
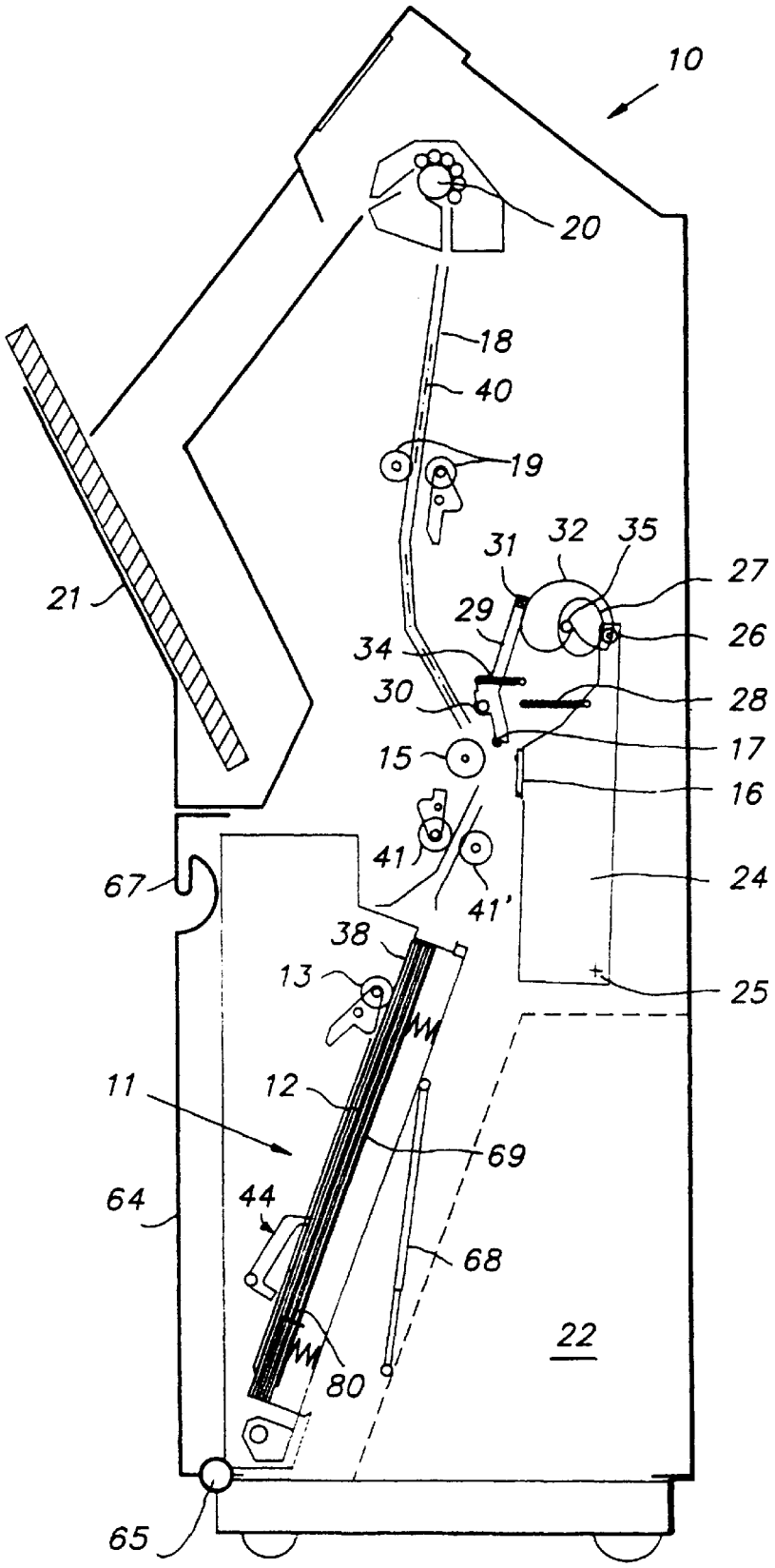
FIG. 4 is a diagrammatic view of one embodiment of a thermal printer to be loaded with a sheet pack according to FIGS. 1 to 3.

FIG. 4 shows the general layout of the printer.

The apparatus is mounted in a housing 10 which comprises a magazine 11 for holding a stack 12 of sheets to be printed in an inwardly tilted position, a dispenser roller 13 for removing the sheets one by one from the stack and for feeding them upwardly, a driven print drum 15, a thermal head 16, a pressure roller 17, guides 18 with sheet driving rollers 19, a de-curl roller 20, an outlet tray 21, and control means 22 for controlling image acquisition and processing. Thermal head 16 is mounted on a rigid frame 24 which is pivotable about axis 25 running strictly parallel with the print drum axis. Frame 24 bears at its free end a follower roller 26 riding on a rotatable cam 27. A tension spring 28 urges the frame in the direction of the print drum.

Pressure roller 17 is mounted for free rotation in a frame 29, see also enlarged FIG. 2, which is pivotable about shaft 30 running likewise parallel to the print drum. Frame 29 bears at its free end a follower roller 31 riding on a cam 32. A tension spring 34 causes frame 29 to urge roller 17 towards the print drum. Both cams 27 and 32 are mounted in the angular relationship as shown on a common shaft 35 which is rotatable by a motor.

The operation of the thermal printer described hereinbefore is as follows.

Dispenser roller 13 is controlled to remove upper sheet 38 from sheet stack 12. The sheet is fed upwardly until its leading end takes a position between print drum 15 and thermal head 16.

Sheet 38 is in this example a heat-sensitive sheet having a heat-sensitive layer coated on a polyethylene terephthalate support. The heat-sensitive layer of all sheets faces downwardly in the drawings of FIGS. 4 and 5. Suitable thermographic materials for medical imaging based on silver behenate in thermal working relationship with a reducing agent are disclosed in our co-pending patent applications EP-A-0 669 875, EP-A-0 669 876 and EP-A-0 726 852.

Figure 5:
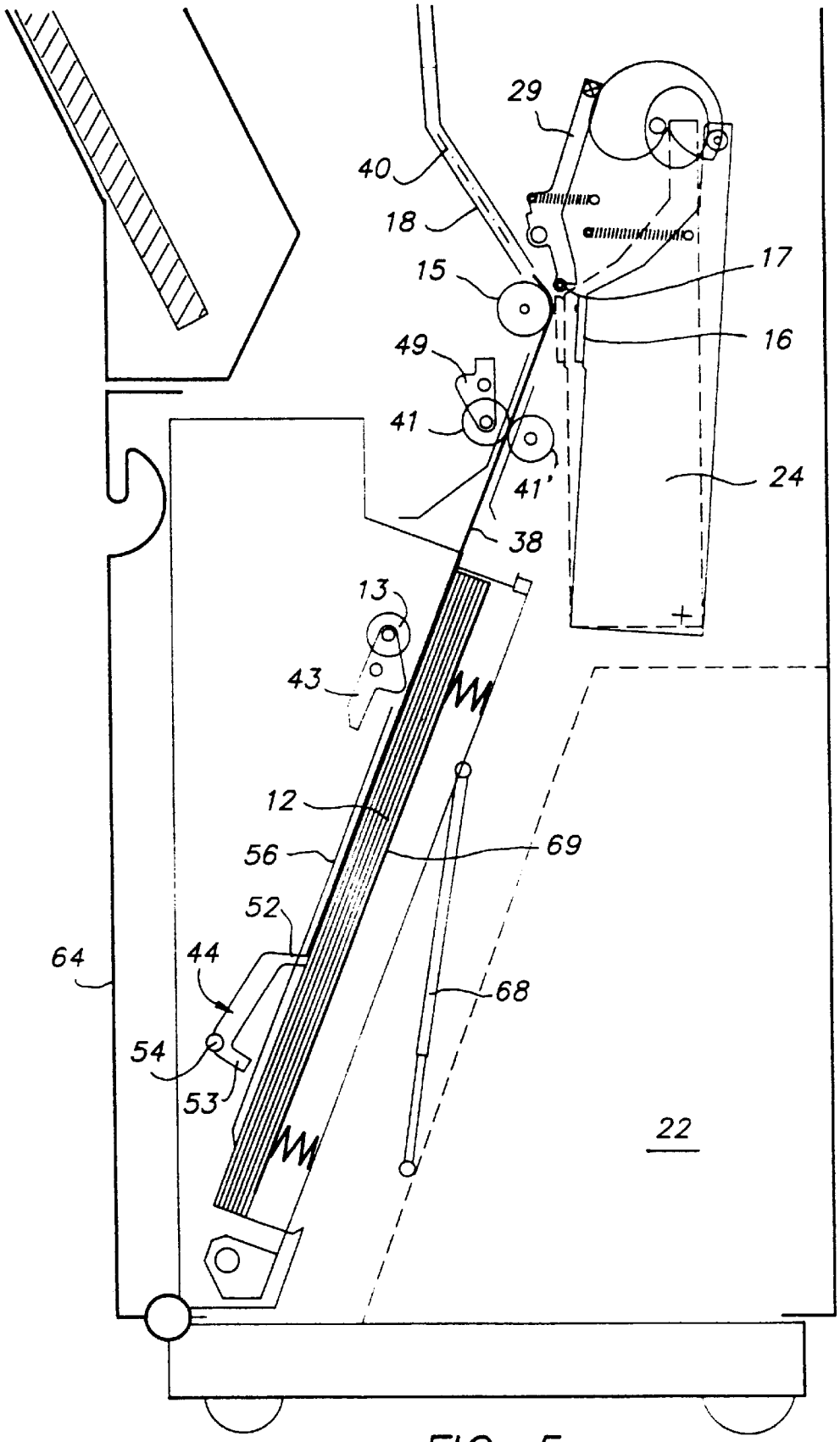
FIG. 5 is an enlarged view of the printer according to FIG. 4.

Next, the driving of dispenser roller 13 is stopped, the roller is removed from sheet stack 12, and roller pair 41, 41' which takes an intermediate position between the sheet stack and the print drum is closed and driven to cause the sheet to move slightly backwardly until it abuts with its trailing edge against stop 44, see FIG. 5. It should be understood that gravity on itself may cause the sheet to move downwardly as roller 13 is lifted from the sheet but friction with machine parts and/or electrostatic attraction towards the next sheet, may reduce the mobility of the removed sheet and therefore it may be desirable to improve control over this backward motion by means of sheet driving rollers such as 41, 41'.

The driving momentum of rollers 41, 41' is limited through appropriate slip clutch means, so that the sheet becomes not buckled as its motion is stopped by contact of its trailing edge with stop 44.

The sheet now takes a position which is ready for starting printing.

The print head is closed, see FIG. 5 which shows the operative position of the print head in broken lines (the corresponding position of the cams has not been shown). Although printing can start up from this moment, the printing quality may be unsatisfactory because of unsufficient control of the speed of the sheet. As a matter of fact, frictional contact between sheet and print drum under the bias of the thermal head is limited to a small area only. Therefore, it is desirable to increase the angle of wrap of the sheet around the drum, and this occurs in the apparatus according to the present embodiment by pressure roller 17 which is moved from its rest position as shown in FIG. 4 to its operative position shown in broken lines in FIG. 5, by appropriate slight further rotation of the cam mechanism (neither this corresponding position of the cams has been shown since it is not required for understanding the operation of feeding and positioning the print sheet). We refer for further details about the cam aspect to our corresponding European patent application No. 96 20 3359 filed on even day herewith, that is on Nov. 28, 1996.

As the sheet is being printed, it is conveyed along path 40 between sheet guide plates 18 up to de-curl roller 20 which is a heated roller in contact with the rear side of the sheet in order to compensate for curling stresses which have been introduced in the sheet by the image-wise heating of its front side. We refer to our co-pending patent application EP-A-0 679 519 wherein the uniform heating of a sheet at its rear side to reduce curl is disclosed.

In this connection it is interesting to know that it is advantageous to keep the sheet drive free from any disturbing influence. The driving and the machining of the de-curl roller are in principle less accurate than those of the print drum and therefore it is desirable not to let interfere the sheet drive of roller 20 with that of drum 15. The length of the sheet path between 15 and 20 is therefore larger than the length of the largest sheet to be printed in the apparatus, and the sheet transport between both said rollers can occur by driven pressure rollers 19 taking an open position as shown in FIG. 4, and being closed as the last image line on the sheet has been printed to take over the sheet drive from the print drum before the trailing sheet edge passes beyond pressure roller 17.

Figure 6:
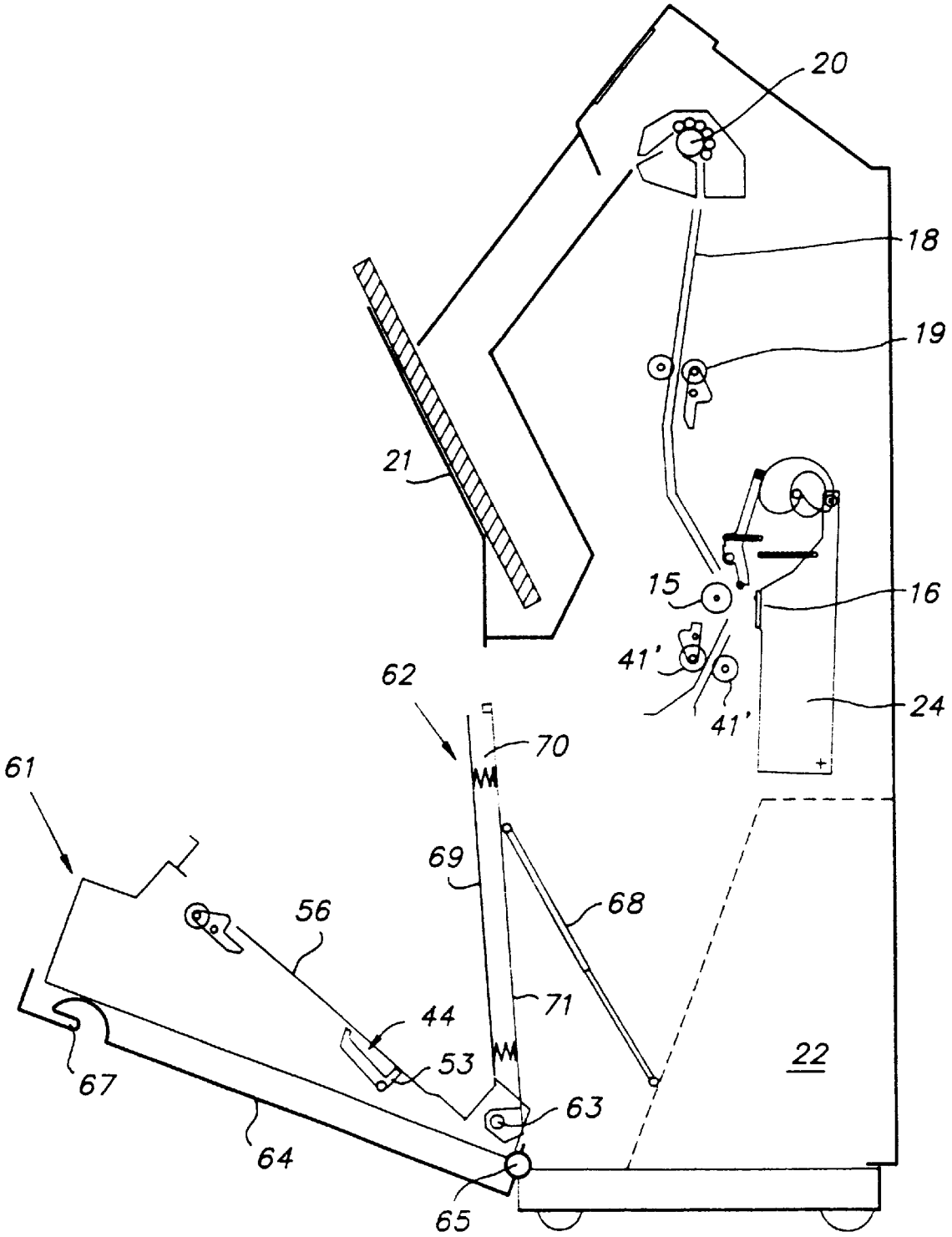
FIG. 6 is a view of the printer of FIG. 4 in its loading position.

The assembly of magazine 11 of the printer is as follows with reference to FIGS. 6 and 7.

The magazine is composed of two compartments, viz. an outside one 61 and an inside one 62 being pivotally connected to the outside one at 63. Outside compartment 61 is mounted in lid 64 which is pivotally mounted to the apparatus with hinge 65 and has a handle 67 for its opening and closing.

Sheet stop 44 is swung anti-clockwise under the influence of gravity and rests with its leg 53 against wall 56 of the magazine.

Inside compartment 62 of the magazine is connected at its rearside by gas spring 68 with a fixed point of the apparatus and takes in the open position of the magazine a nearly vertical position. Compartment 62 has a sheet pressure plate 69 connected by springs 70 to bottom 71.

Sheet loading is now described with reference to FIGS. 7 to 10.

Figure 7:
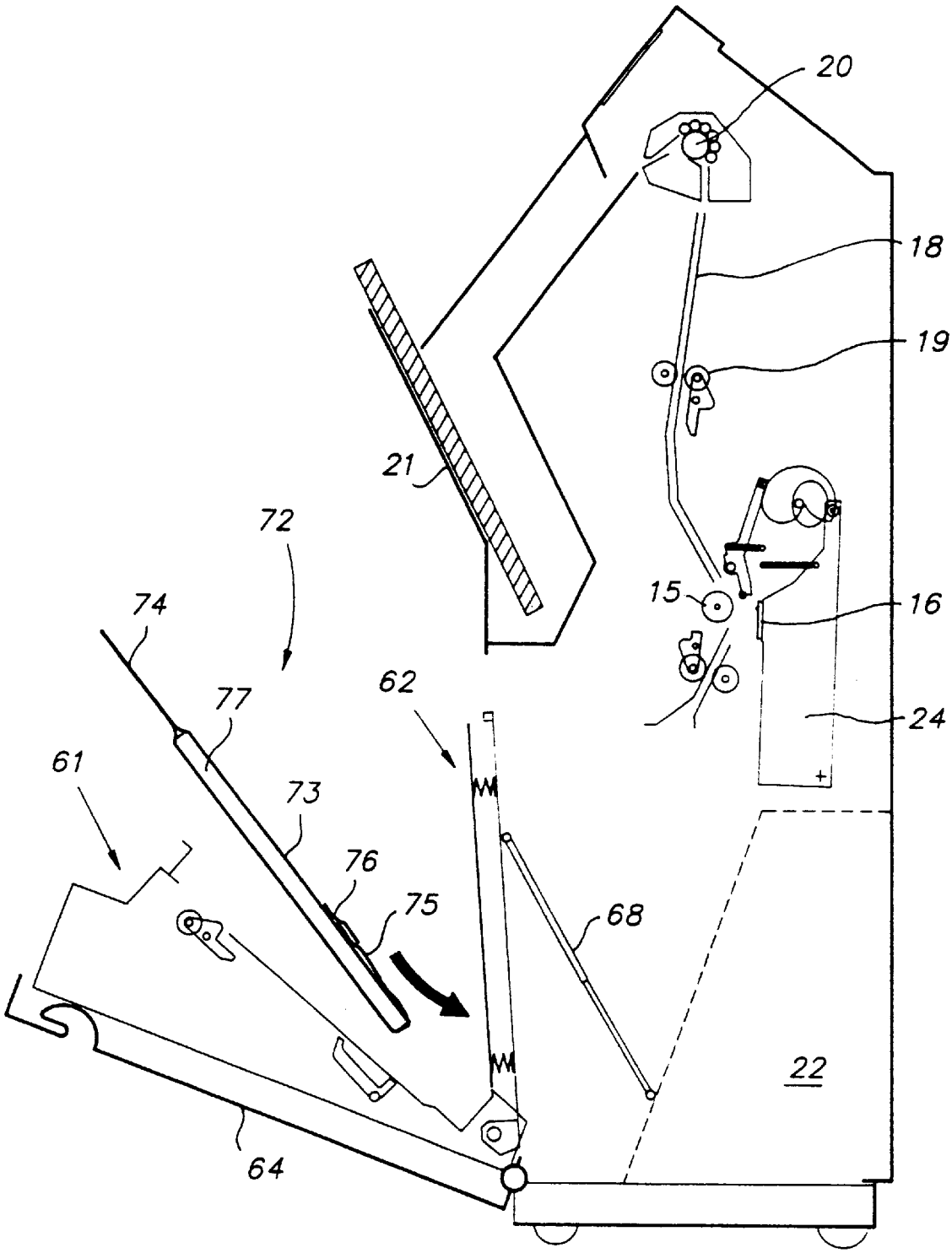
FIG. 7 shows the introduction of a sheet pack.

A sheet pack 72 is slid in the open compartment 61 of the magazine as shown by the bold arrow in FIG. 7.

Figure 8:
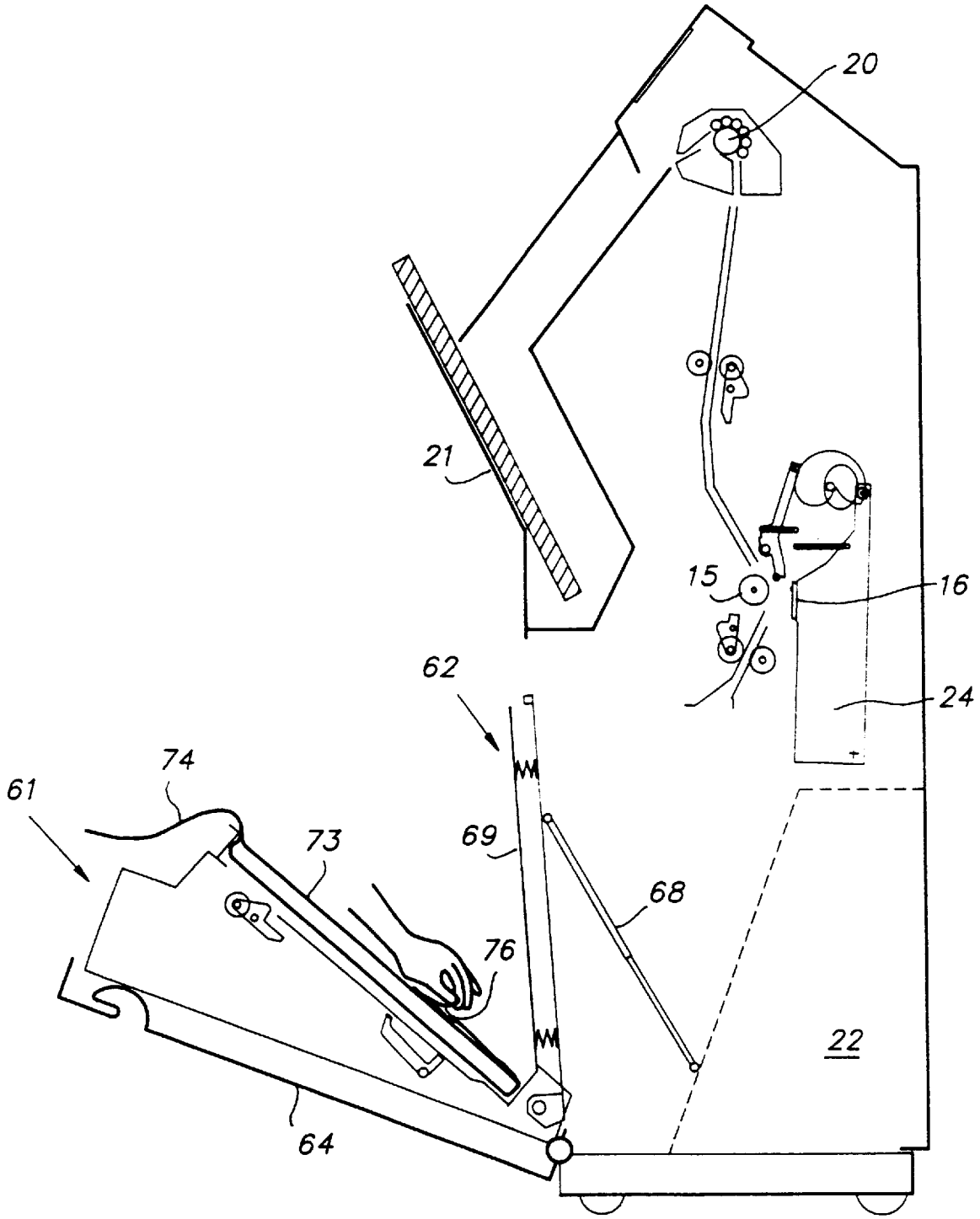
FIG. 8 shows the opening of the sheet pack of FIG. 7.
Figure 9:
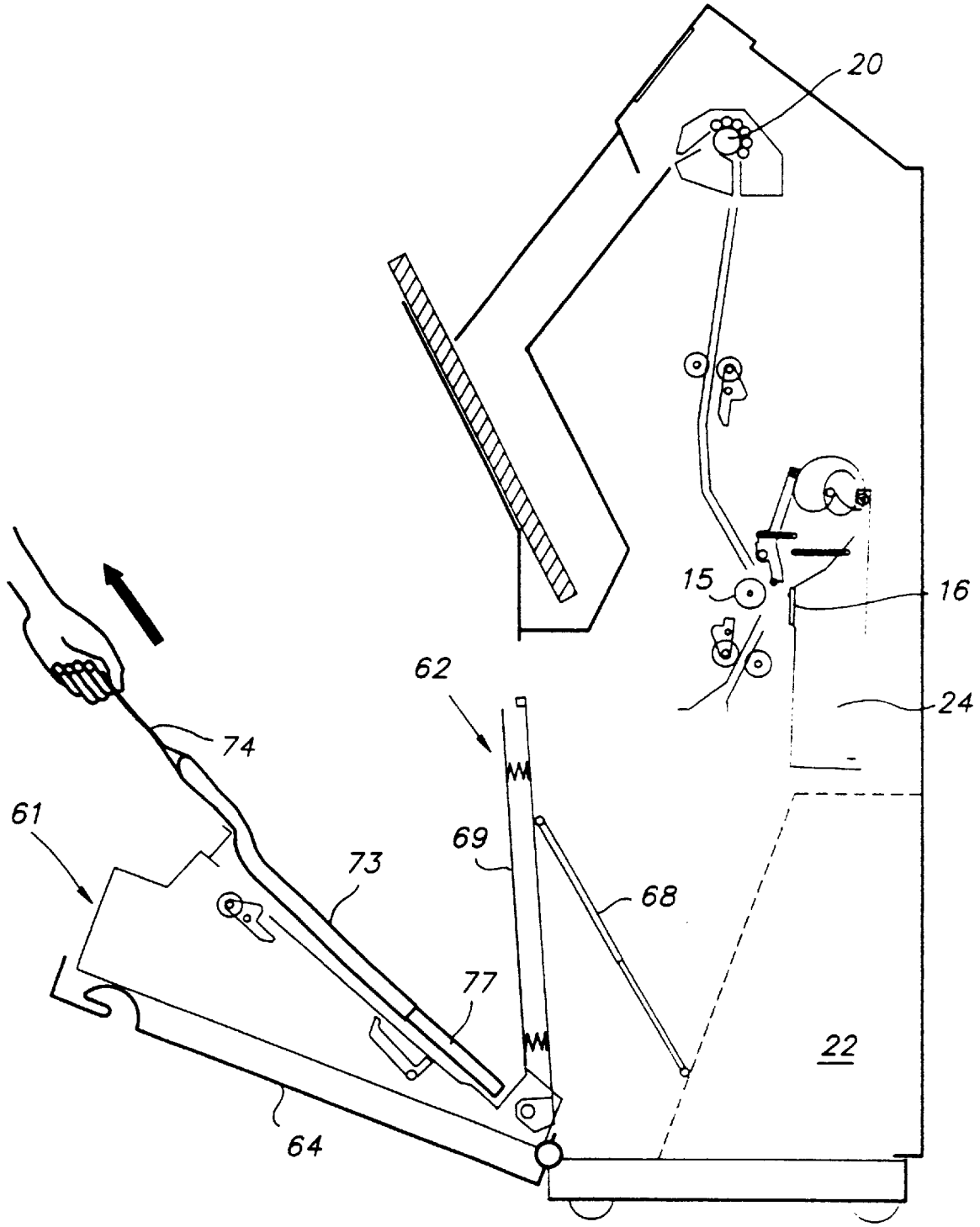
FIG. 9 shows the removal of the wrapping from the sheet stack.
Figure 10:
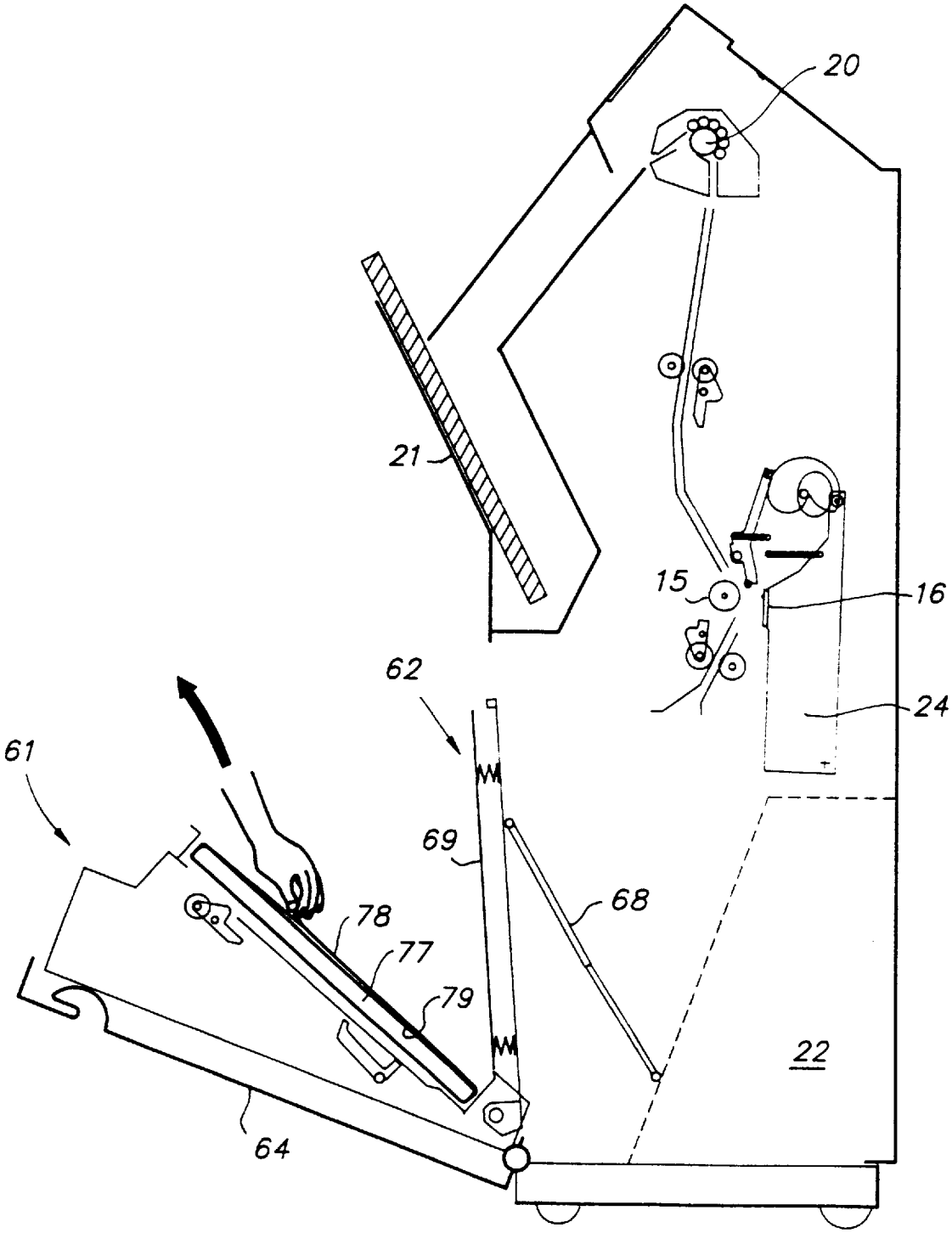
FIG. 10 shows the removal of the strap keeping the sheets together.

The operator removes sealing tape 76, see FIG. 8, and then withdraws wrapper 72 from the sheet stack by means of its tail portion 74, see FIG. 9. The sheets of stack 77 are still held together by an encircling band or strap 78 which prevents mutual movement of the sheets as their wrapper is removed, or the remaining of one or more sheets in the removed wrapper. This strap is detached and next removed, see FIG. 10.

We have found that it is desirable to protect the upper sheet of the stack of sheets, and to a lesser degree the underlying ones, against finger marks and finger pressure by means of a protective foil or board 79. The strap just described may be removably attached to such foil to further exclude mutual movements of the sheets during their loading. The mentioned protective foil remains on the stack.

Figure 11:
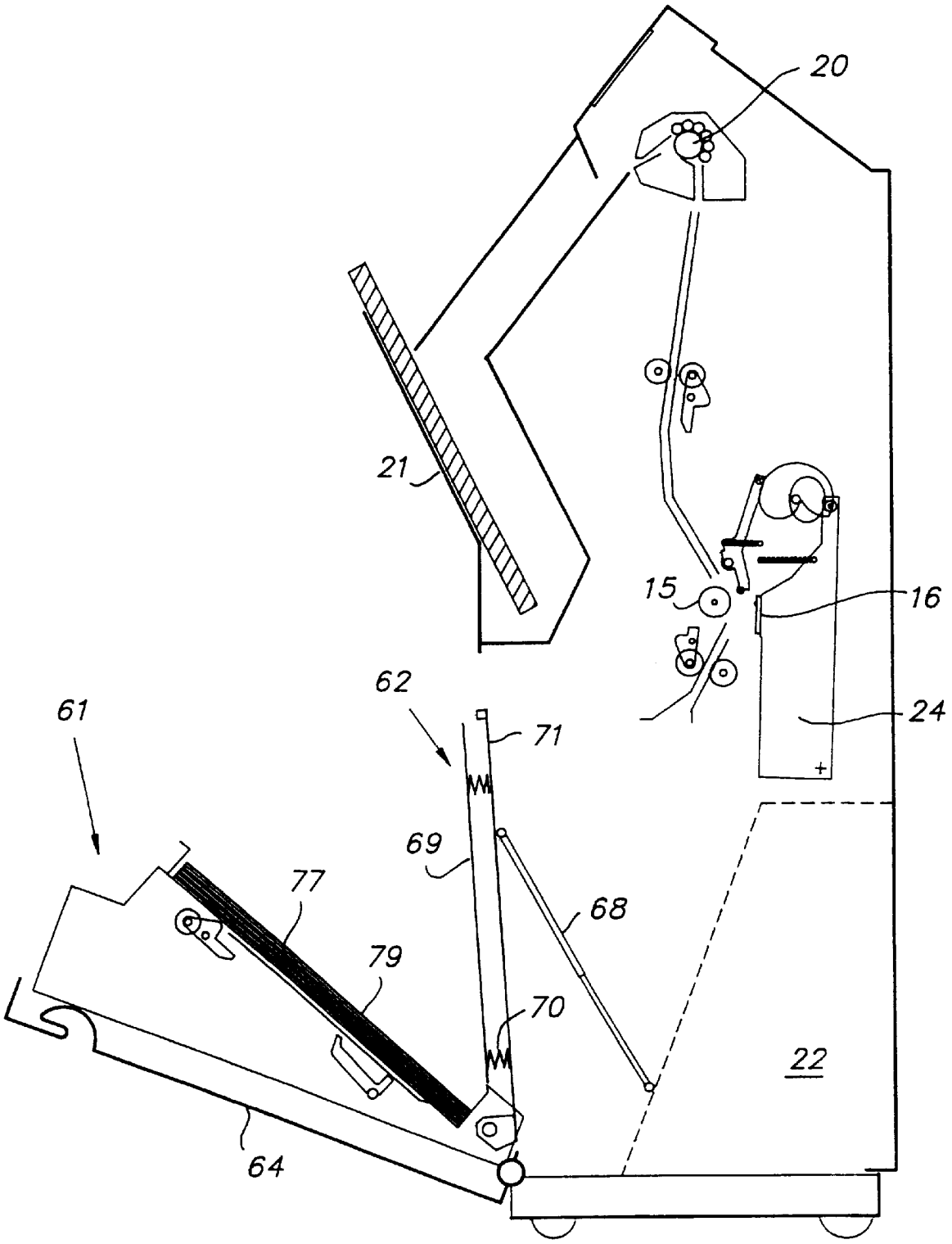
FIG. 11 shows the loaded margazine of the printer.

The magazine being loaded as shown in FIG. 11, lid 64 is now closed by swinging it in the position as shown in FIG. 4. As compartment 61 has reached a nearly vertical position, foil 79 comes in contact with pressure plate 69. Further closing of the lid causes the sheets first to compress springs 70 and next to swing magazine compartment 62 inwardly, thereby compressing gas spring 68 until the operative dispensing position of FIG. 4 is obtained. In this position the upper sheet of the stack is withheld only by engagement of its trailing and leading margin by corresponding lips of the magazine, and thus engagement of the sheet by dispensing roller 13 provokes its removal from the stack as described hereinbefore.

The apparatus described hereinbefore can easily be adjusted to smaller sheet formats. Such adjustment may comprise brackets such as 80 shown in broken lines in FIG. 4 which can be fitted at different heights in the magazine and which reduce the available length for the sheets.

Sheet stop 44 needs to be adjusted accordingly and this may occur by arranging wall 56 for the mounting of such stop at different heights, or by providing this wall with several stops at different heights, and blocking the operation of all stops except one by means of a suitable locking pin or the like so that only one stop at a time protrudes through plate 56 and rests on the upper sheet of the stack.

Figure 12:
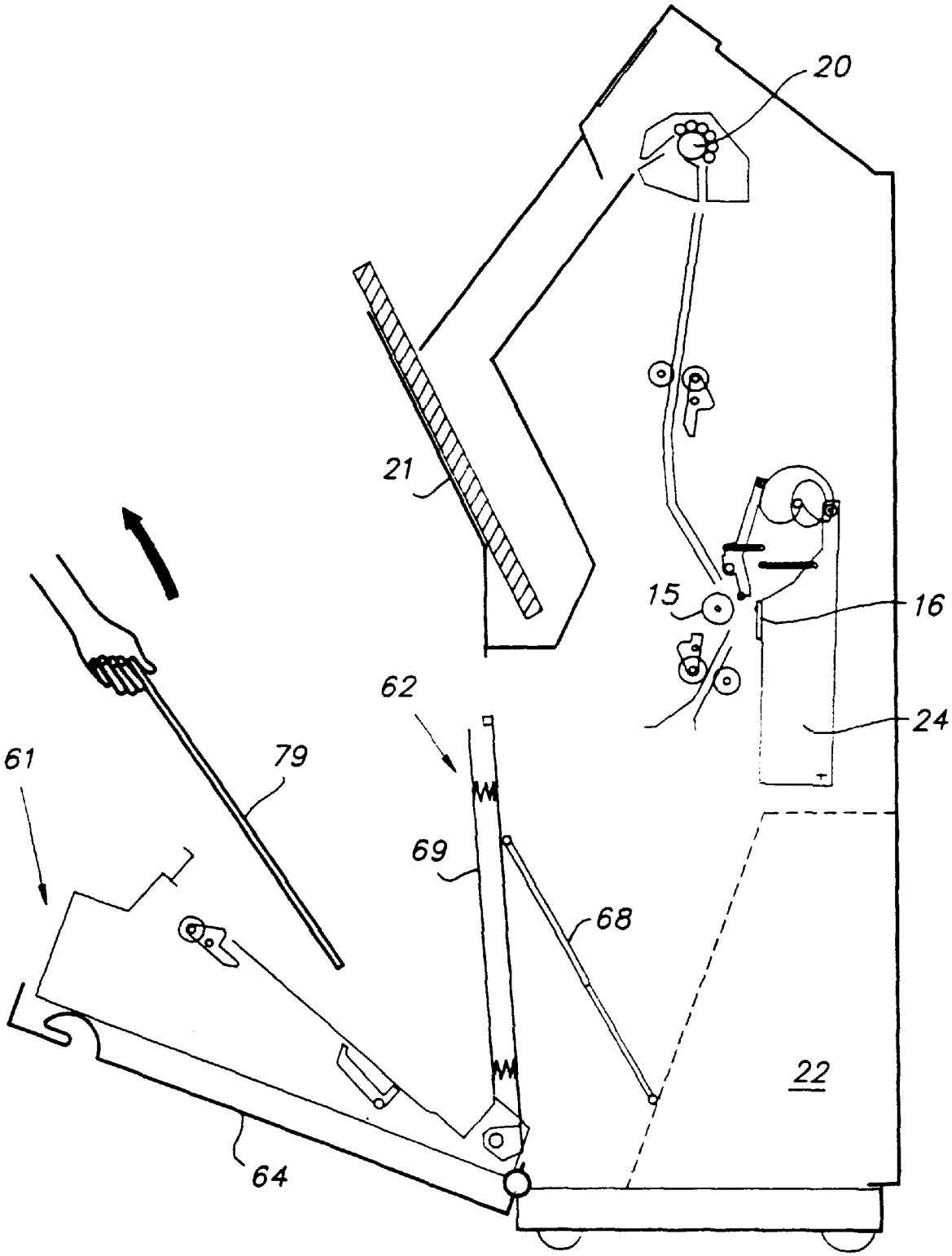
FIG. 12 shows the removal of the protective foil.

After all the sheets of the sheet stack have been printed protective foil 79 remains in magazine 11. After the magazine has been opened, see FIG. 12, this foil has to be taken away as shown by the bold arrow before a next sheet pack can be loaded.

A sheet pack according to the invention is not limited to the embodiment described hereinbefore.

The sheets need not necessarily be thermal-sensitive but may also be otherwise sensitive, e.g. sheets capable of producing an image by exposure to UV or to far IR-radiation.

The strap may have a shape that is much wider than the one shown in the drawings, and in the extreme case it may have the form of a rupturable sleeve encircling the sheet stack over its full width and providing thereby an extra protection for the sheets.

The wrapping bag for the sheets may have no tail portion as flap 74, but instead be attached with its bottom to the adjacent bottom wall of the cardboard box so that after opening the box and the wrapping bag, the box may be kept tilted to cause the sheet stack to slide in the opened magazine, in a way as shown in FIG. 7 for pack 72.

We claim:

1. A pack of substantially light-insensitive sheets, which comprises a stack of sheets bearing each an image-forming layer on one sheet side, a protective foil in contact with the image-forming layer of the outermost sheet of the stack, a strap encircling the stack of sheets and the protective foil, and a wrapping bag enclosing the stack.

2. A pack of sheets according to claim 1, wherein the strap is arranged for easy opening at the side of the protective sheet.

3. A pack of sheets according to claim 2, wherein the easy opening is obtained through a rupturable seal between both overlapping ends of the strap.

4. A pack of sheets according to claim 3, wherein the strap is attached to the protective foil.

5. A pack of sheets according to claim 4, wherein the attachment is rupturable.

6. A pack of sheets according to claim 5, wherein the rupturable attachment comprises a label stuck transversely over the strap onto the protective foil.

7. A pack of sheets according to claim 1, wherein the sheets are thermal-sensitive.

8. A pack of sheets according to claim 1, wherein the bag is airtight.

9. A pack of sheets according to claim 1, wherein the bag has a closed tail portion and an openable leading portion folded back on the pack prior to the first use of the pack.

10. A pack of sheets according to claim 7, which is packaged in a cardboard box comprising a base and a lid, the bag being attached to the base of the box.

* * * * *